US011229246B2

(12) United States Patent
McHugh

(10) Patent No.: US 11,229,246 B2
(45) **Date of Patent: *Jan. 25, 2022**

(54) GARMENT EXTENDER

(71) Applicant: Michael Benjamin McHugh, Pointe-Claire (CA)

(72) Inventor: Michael Benjamin McHugh, Pointe-Claire (CA)

( * ) Notice: Subject to any disclaimer, the term of this patent is extended or adjusted under 35 U.S.C. 154(b) by 257 days.

This patent is subject to a terminal disclaimer.

(21) Appl. No.: 16/708,800

(22) Filed: Dec. 10, 2019

(65) Prior Publication Data

US 2020/0107593 A1 Apr. 9, 2020

Related U.S. Application Data

(63) Continuation of application No. 15/695,395, filed on Sep. 5, 2017, now Pat. No. 10,537,142.

(51) Int. Cl.

| | |
|---|---|
| ***A41D 15/00*** | (2006.01) |
| ***A41D 3/00*** | (2006.01) |
| ***A41D 1/21*** | (2018.01) |

(52) U.S. Cl.

CPC ..... *A41D 15/00* (2013.01); *A41D 1/21* (2018.01); *A41D 3/00* (2013.01); *A41D 2300/20* (2013.01); *A41D 2300/322* (2013.01); *A41D 2300/324* (2013.01); *A41D 2400/482* (2013.01)

(58) Field of Classification Search

CPC . A41D 3/00; A41D 1/21; A41D 1/215; A41D 1/22; A41D 2400/82; A41D 2300/324; A44B 19/30; A44B 19/28; A44B 19/267; A41F 1/008

USPC ..... 2/96

See application file for complete search history.

(56) References Cited

U.S. PATENT DOCUMENTS

| | | | | |
|---|---|---|---|---|
| 782,803 | A | 2/1905 | Watson, Jr. | |
| 2,122,442 | A | 7/1938 | Palmer et al. | |
| 3,875,623 | A | 4/1975 | Johnston | |
| 5,140,727 | A | 8/1992 | Dais et al. | |
| 5,273,511 | A | 12/1993 | Boeckman | |
| 5,758,868 | A | 6/1998 | Shea | |
| 5,813,094 | A * | 9/1998 | Perez, II | A44B 19/00 24/381 |
| 5,934,806 | A | 8/1999 | Tomic | |
| 6,493,909 | B2 | 12/2002 | Paul | |
| 7,979,965 | B2 | 7/2011 | Lo | |
| 8,806,726 | B1 | 8/2014 | Lo | |

(Continued)

FOREIGN PATENT DOCUMENTS

| | | |
|---|---|---|
| DE | 102013109704 | 3/2015 |
| GB | 2561522 | 10/2018 |
| WO | 2016109761 | 12/2015 |

OTHER PUBLICATIONS

Pictures taken by the applicant and provided in file "Exhibit_A.pdf" of a physical product that was known by the applicant at least as early as Dec. 2014.

*Primary Examiner* — Timothy K Trieu

(57) ABSTRACT

A garment extender including: a body provided with an attachment at each side thereof, each of the attachments defining a channel and a slit leading laterally into the channel. When the attachment is operatively secured to a garment slide fastener of a garment, a gripped portion of one of the stringer tapes of the garment slide fastener is inserted in the slit and the channel receives thereinto teeth that are supported by the stringer tape adjacent the gripped portion.

23 Claims, 7 Drawing Sheets

(56) References Cited

U.S. PATENT DOCUMENTS

| | | | | |
|---|---|---|---|---|
| 2008/0256679 | A1* | 10/2008 | White | A41D 15/00 2/84 |
| 2010/0107300 | A1 | 5/2010 | Yiu | |
| 2010/0138973 | A1 | 6/2010 | Summons | |
| 2014/0189930 | A1* | 7/2014 | Solomon | A41D 3/02 2/69 |
| 2018/0078051 | A1* | 3/2018 | McHugh | A47D 13/025 |

* cited by examiner

GARMENT EXTENDER

FIELD OF THE INVENTION

The present invention relates to the general field of clothing, and is more specifically concerned with a garment extender.

BACKGROUND

Garment extenders, for example coat or jacket extenders, are useful for pregnant women, among others. Using such garment extenders, not only can the pregnant woman use the clothes she owns during pregnancy, but she can also use the extended garment to protect a baby carried in a baby carrier after giving birth. One problem with existing garment extenders is that they typically attach to an existing slide fastener, commonly referred to as a zipper, of the garment. Since there are many incompatible slide fasteners types on the market, this requires a large inventory of garment extenders to fit different brands and models of zip fasteners. Also, the buyer of the garment extender has to guess which type of slide fastener is used in the existing garment, or requires the help of a specialized salesperson to select the right type of garment extender that will zip to the existing slide fastener.

Accordingly, there exists a need for an improved garment extender. It is a general objective of the present invention to provide such an improved garment extender.

SUMMARY OF THE INVENTION

In a broad aspect, the invention provides a garment extender usable with a garment having a garment slide fastener, the garment slide fastener having a pair of substantially elongated stringer tapes supporting each a row of teeth extending longitudinally therealong, the garment slide fastener also having a slider movable along the rows of teeth in a reciprocating movement for selectively attaching the teeth of both rows to each other when moved in a closing direction and selectively detaching the teeth of both rows from each other when moved in an opening direction opposed to the closing direction, the garment extender comprising: a body defining substantially opposed body first and second side edges and opposed body top and bottom edges extending each between the body first and second side edges; at least two attachments provided each at a respective one of the body first and second side edges, each of the attachments defining a channel defining a channel axis extending substantially parallel to one of the body first and second side edges at which the attachment is provided, each of the attachments also defining a slit parallel to the channel axis and leading laterally into the channel along the whole channel. With the attachments operatively secured to the garment slide fastener, the slit of each attachment receives thereinto a gripped portion of one of the stringer tapes therebetween and the channel of the attachment receives thereinto the teeth that are supported by the stringer tape adjacent the gripped portion.

In some embodiments, the invention may also provide a garment extender wherein each of the body first and second side edges is provided with a plurality of attachments spaced apart therealong, each of the attachments defining a channel defining a channel axis extending substantially parallel to one of the body first and second side edges and a slit parallel to the channel axis and leading laterally into the channel along the whole channel, the slits facing away from the body.

In some embodiments, the invention may also provide a garment extender wherein the attachments provided at one of the body first and second side edges are linked to each other in an attachment string through a flexible link.

In some embodiments, the invention may also provide a garment extender wherein the flexible link is less rigid than the attachments.

In some embodiments, the invention may also provide a garment extender further comprising a clip operable for gripping the stringer tape to maintain the stringer tape and the garment extender substantially fixed relative to each other.

In some embodiments, the invention may also provide a garment extender wherein, with the garment extender operatively secured to the garment, the clip is operable for selectively and reversibly gripping jointly one of the flexible link and one of the stringer tapes adjacent to the one of the flexible link.

In some embodiments, the invention may also provide a garment extender wherein the clip is secured to one of the body and flexible link between two adjacent ones of the attachments and, with the garment extender operatively secured to the garment, the clip is operable for selectively and reversibly gripping one of the stringer tapes between the two adjacent ones of the attachments.

In some embodiments, the invention may also provide a garment extender wherein the attachments provided at at least one of the body first and second side edges include two opposed end attachments and intermediate attachments provided therebetween, wherein, with the flexible link folded over itself adjacent one link end thereof, the end attachment adjacent to the one link end is insertable between two adjacent ones of the intermediate attachments.

In some embodiments, the invention may also provide a garment extender wherein each slit is defined between a pair of slit edges, each slit defining axially opposed slit end portions and a slit intermediate portion therebetween, at least one of the slit edges being bevelled in the slit end portions so that an axial access to the slit is tapered towards the slit intermediate portion.

In some embodiments, the invention may also provide a garment extender wherein the attachment has a substantially C-shaped transversal cross-sectional configuration.

In some embodiments, the invention may also provide a garment extender wherein each of the attachments includes attachment inside and outside portions, the attachment inside portion including an inside gripping portion and an inside channel forming portion, the attachment outside portion including an outside gripping portion and an outside channel forming portion; and with the attachment operatively secured to the garment slide fastener, the inside and outside gripping portions form the slit and grip a gripped portion of one of the stringer tapes therebetween and the inside and outside channel forming portions define the channel receiving thereinto the teeth that are supported by the stringer tape adjacent the gripped portion.

In some embodiments, the invention may also provide a garment extender wherein the attachments are removably attachable to the garment slide fastener.

In some embodiments, the invention may also provide a garment extender wherein the attachment inside and outside portions are movable relative to each other between a closed configuration and an open configuration, the attachment being in the closed configuration when the attachment is attached to the garment slide fastener and the inside and outside gripping portions being spaced apart from each other to a greater extent in the open configuration than in the closed configuration to allow detachment of the attachment from the garment slide fastener.

In some embodiments, the invention may also provide a garment extender wherein each attachment further includes a lock for selectively locking the attachment in the closed configuration.

In some embodiments, the invention may also provide a garment extender wherein the lock prevents the attachment inside and outside portions from moving from the closed configuration to the open configuration unless a predetermined force moving the attachment inside and outside portions away from each other is exerted.

In some embodiments, the invention may also provide a garment extender wherein the lock includes lock inside and outside elements provided respectively in the attachment inside and outside portions, the lock inside and outside elements being complementarily shaped to snap to each other in the closed position.

In some embodiments, the invention may also provide a garment extender wherein the inside channel forming portion is between the inside gripping portion and lock inside element and the outside channel forming portion is between the outside gripping portion and lock outside element.

In some embodiments, the invention may also provide a garment extender wherein each attachment includes an attachment linking portion linking the attachment inside and outside portions to each other.

In some embodiments, the invention may also provide a garment extender wherein the attachment inside and outside portions are more rigid than the attachment linking portion.

In some embodiments, the invention may also provide a garment extender wherein the attachment linking portion defines inside and outside portion apertures respectively receiving the attachment inside and outside portions thereinto.

In some embodiments, the invention may also provide a garment extender wherein the attachment linking portion defines at least one groove thereinto between the inside and outside portion apertures for facilitating hinging between the attachment inside and outside portions.

In some embodiments, the invention may also provide a garment extender wherein the garment extender further includes inside and outside strips between the attachment and the body, the attachment linking portion being secured to the inside and outside strips, the inside and outside strips being secured to the body.

In some embodiments, the invention may also provide a garment extender wherein the inside and outside gripping portions each include a flange, the flanges facing each other and gripping the stringer tape therebetween in the closed configuration.

In some embodiments, the invention may also provide a garment extender wherein the garment extender is provided with an extender slide fastener extending between the body top and bottom edges.

In some embodiments, the invention may also provide a garment extender wherein the garment extender is provided with a pair of laterally spaced apart extender slide fasteners extending between the body top and bottom edges.

In some embodiments, the invention may also provide a garment extender further comprising a fixation attachment, the fixation attachment including attachment inside and outside portions, the attachment inside portion including an inside gripping portion and an inside channel forming portion, the attachment outside portion including an outside gripping portion and an outside channel forming portion; wherein with the fixation attachment operatively secured to the garment slide fastener, the inside and outside gripping portions form a fixation attachment slit gripping a fixation gripped portion of one of the stringer tapes therebetween and the inside and outside channel forming portions define a fixation attachment channel receiving thereinto the teeth that are supported by the stringer tape adjacent the fixation gripped portion, the attachment inside and outside portions being movable relative to each other between a closed configuration and an open configuration, the fixation attachment being in the closed configuration when the fixation attachment is attached to the garment slide fastener and the inside and outside gripping portions being spaced apart from each other to a greater extent in the open configuration than in the closed configuration to allow detachment of the fixation attachment from the garment slide fastener, the fixation attachment further including a lock for selectively locking the fixation attachment in the closed configuration.

In another broad aspect, the invention provides an expanded garment, comprising: a jacket having a garment slide fastener, the garment slide fastener having a pair of substantially elongated stringer tapes supporting each a row of teeth extending longitudinally therealong, the garment slide fastener also having a slider movable along the rows of teeth in a reciprocating movement for selectively attaching the teeth of both rows to each other when moved in a closing direction and selectively detaching the teeth of both rows from each other when moved in an opening direction opposed to the closing direction; and the garment extender as described hereinabove attached to the jacket between the stringer tapes of the garment slide fastener.

In yet another broad aspect, there is provided a garment extender usable with a garment having a garment slide fastener, the garment slide fastener having a pair of substantially elongated stringer tapes supporting each a row of teeth extending longitudinally therealong, the garment slide fastener also having a slider movable along the rows of teeth in a reciprocating movement for selectively attaching the teeth of both rows to each other when moved in a closing direction and selectively detaching the teeth of both rows from each other when moved in an opening direction opposed to the closing direction, the garment extender comprising: a body defining substantially opposed body first and second side edges and opposed body top and bottom edges extending each between the body first and second side edges; a plurality of attachments each provided at one of the body first and second side edges, each of the attachments defining a channel defining a channel axis extending substantially parallel to one of the body first and second side edges at which the attachment is provided, each of the attachments also defining a slit leading laterally into the channel along the whole channel, the slit being configured and sized to allow the attachments to slide along the stringer tapes; wherein, with the attachments operatively secured to the garment slide fastener, the slit of each attachment receives thereinto a received portion of one of the stringer tapes therebetween and the channel of the attachment receives thereinto the teeth that are supported by the stringer tape adjacent the received portion, the attachments being slidable along the stringer tapes so that the garment extender is mountable the garment and removable therefrom by sliding the attachments along the stinger tapes.

In yet another broad aspect, there is provided a method for mounting the garment extender of the previous paragraph to a garment having a garment slide fastener, the garment slide fastener having a pair of substantially elongated stringer tapes supporting each a row of teeth extending longitudinally therealong, the method comprising: (a) aligning the teeth of one half of the slide fastener with the channel of one of the attachments provided at a selected side from the body first and second side edges; (b) moving the one of the attachments along the stringer tape to mount the attachment to the stringer tape; and (c) repeating steps (a) and (b) for successive attachments provided at the selected side while moving already mounted attachments along the stringer tape to provide space for the successive attachments to me mounted to the stringer tape.

There may also be provided a method wherein after a first attachment has been mounted to the stringer tape, successive attachments are automatically aligned with the stringer tape at step (c).

There may also be provided a method wherein after a first attachment has been mounted to the stringer tape, successive attachments are aligned manually before being engaged on the the stringer tape with the teeth positioned in the channel at step (c).

Advantageously, by securing the garment extender through engagement with the stringer tape of the garment slide fastener, instead of engaging the teeth thereof, it is possible to manufacture an attachment that attaches to most types of garment slide fasteners, without requiring customization to specific brands and models of garment slide fasteners.

Other objects, advantages and features of the present invention will become more apparent upon reading of the following non-restrictive description of preferred embodiments thereof, given by way of example only with reference to the accompanying drawings.

DETAILED DESCRIPTION

The term "substantially" is used throughout this document to indicate variations in the thus qualified terms. These variations are variations that do not materially affect the manner in which the invention works and can be due, for example, to uncertainty in manufacturing processes or to small deviations from a nominal value that do not cause significant changes to the invention. These variations are to be interpreted from the point of view of the person skilled in the art.

Figure 1:
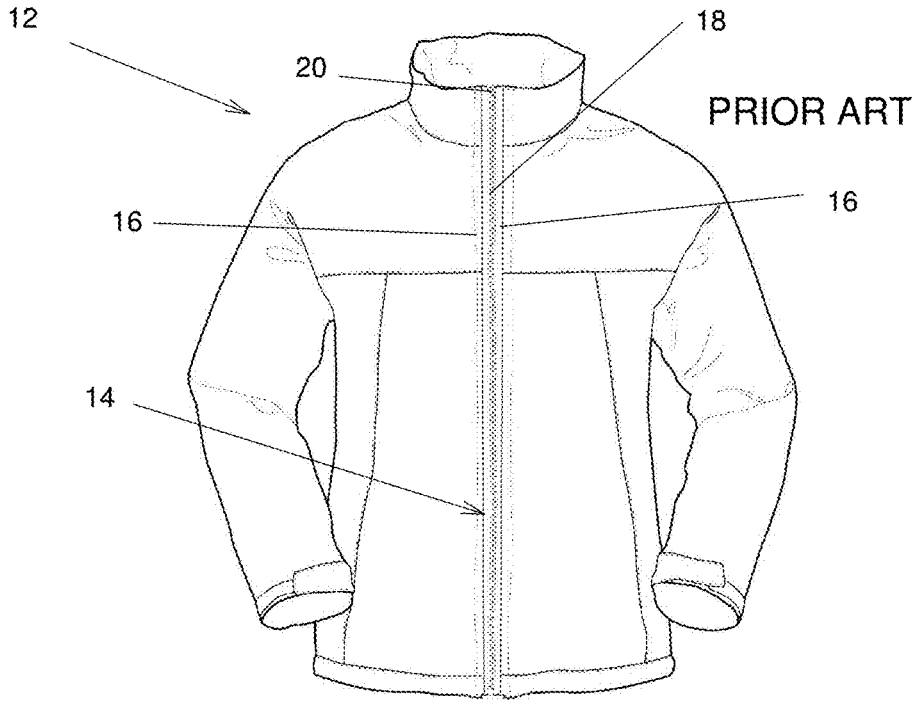
FIG. 1, in a front elevation view, illustrates a garment in the form of a jacket.

FIG. 1 illustrates a conventional garment 12, here shown in the form of a jacket. The garment 12 has a garment slide fastener 14. The garment slide fastener 14 has a pair of substantially elongated stringer tapes 16 supporting each a row of teeth 18 extending longitudinally therealong. The stringer tape 16 is a ribbon of any suitable material, such as, non-limitingly, webbing. The garment slide fastener 14 also has a slider 20 movable along the rows of teeth 18 in a reciprocating movement for selectively attaching the teeth 18 of both rows to each other when moved in a closing direction and selectively detaching the teeth 18 of both rows from each other when moved in an opening direction opposed to the closing direction. Such slide fasteners are conventional and the garment slide fastener 14 is not described in further details herein.

Figure 2:
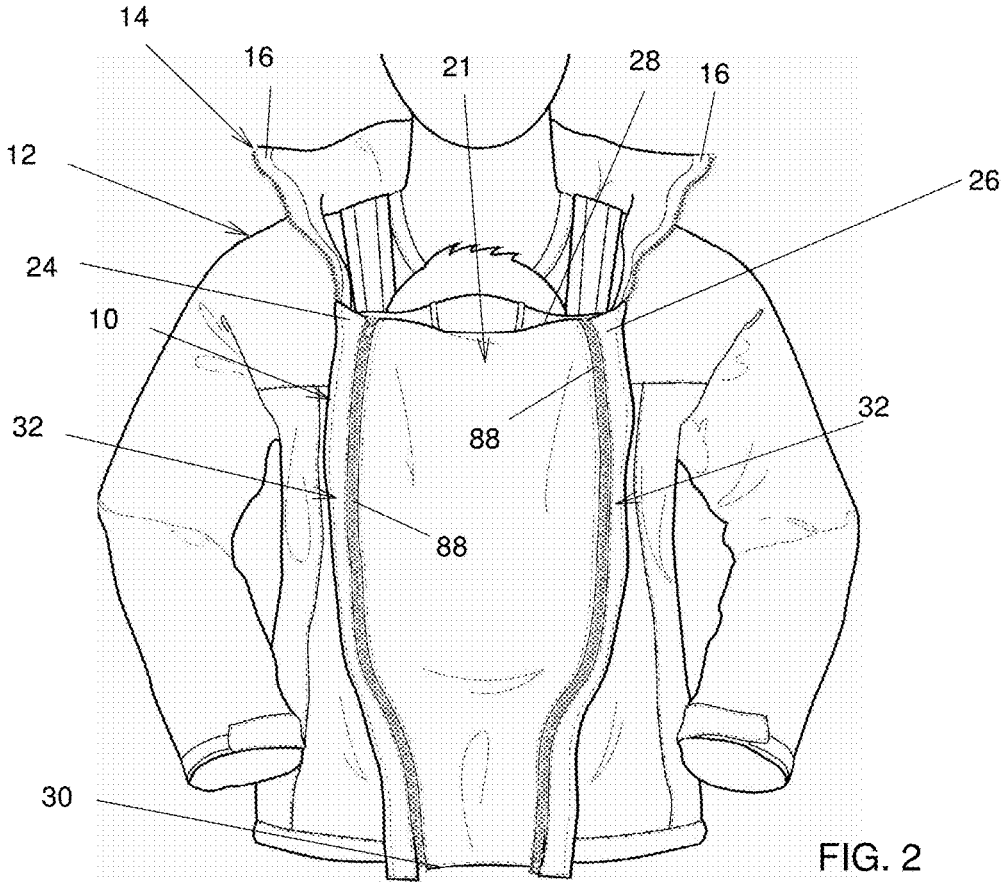
FIG. 2, in a front elevation view, illustrates the garment of FIG. 1 to which is attached a garment extender in accordance with an embodiment of the present invention.

Referring to FIG. 2, a garment extender 10 is attachable to the garment slide fastener 14 to allow extension of the garment 12. For example, the garment extender 10 is usable with a garment 12 in the form of a jacket to leave room for the expanding belly of a pregnant woman or to allow a parent to carry a baby in a baby carrier. However, the garment extender 10 is usable for any other suitable purpose. In some embodiments, the garment extender 10 is attached between spaced apart stringer tapes 16 of the garment slide fastener 14. In other embodiments, for example if the garment extender 10 is used with pants, the stringer tapes 16 are not separated completely along their whole length.

Instead, the stringer tapes 16 form a V-shaped gap therebetween in which the garment extender 10 may be positioned (not shown in the drawings).

Figure 3:
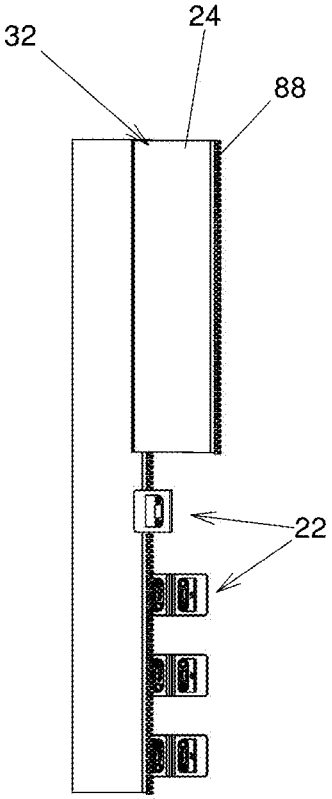
FIG. 3, in a front elevation view with parts removed, illustrates part of the garment extender and garment of FIG. 2.

The garment extender 10 includes a body 21 and at least one attachment 22, some of which are seen for example in FIG. 3. The body 21 includes one or more elements that are positioned in the gap between the stringer tapes 16 of the garment slide fastener 14. In a typical embodiment, the body 21 includes one or more panels of fabric, and, in some embodiment, insulating material. Referring to FIG. 2, The body 21 defines substantially opposed body first and second side edges 24 and 26 and opposed body top and bottom edges 28 and 30 extending each between the body first and second side edges 24 and 26.

Each of the body first and second side edges 24 and 26 is typically provided with at least one respective attachment 22. In some embodiments, each of the body first and second side edges 24 and 26 is provided with a respective plurality of the attachments 22 spaced apart from each other along the body first and second side edges 24 and 26. For example, the attachments 22 are part of two attachment strings 32, each attachment string 32 including attachments 22 linked to each other and secured to one of the body first and second side edges 24 and 26. However, in other embodiments, the attachments 22 are each separately secured to the body 21. In other embodiments, only one attachment 22 is provided at each of the body first and second side edges 24 and 26.

Figure 4:
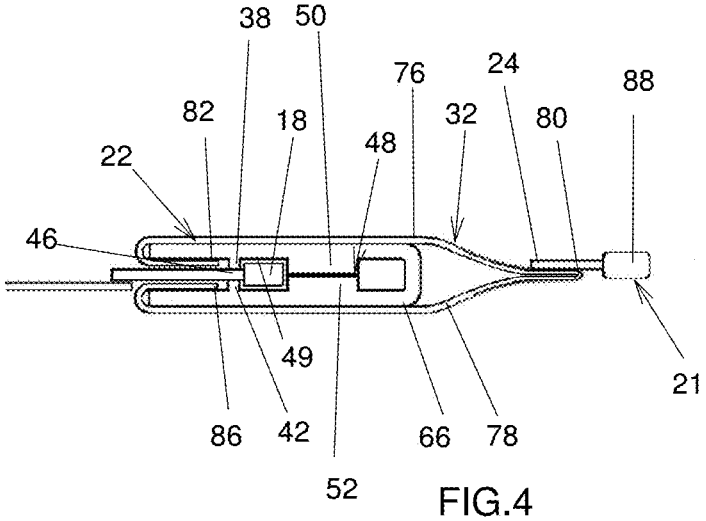
FIG. 4, in a top plan view, illustrates part of the garment and garment extender of FIG. 2.
Figure 5:
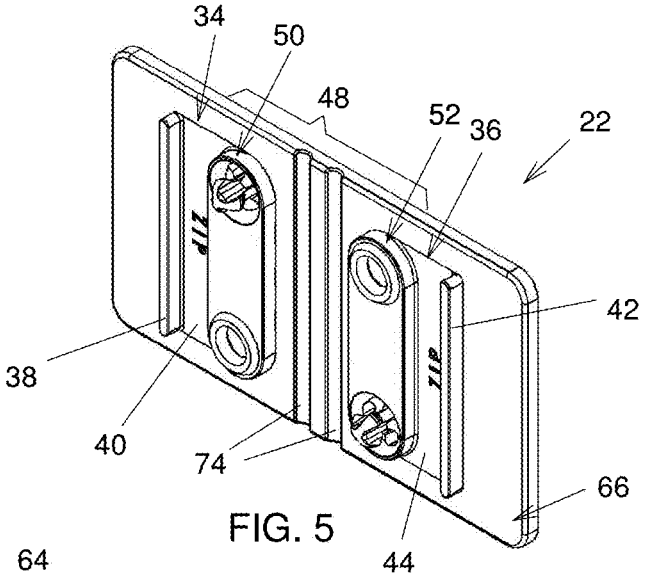
FIG. 5, in a perspective view, illustrates an attachment part of the garment extender of FIG. 2, the attachment being shown in an open configuration.

Referring for example to FIG. 5, each of the attachments 22 includes attachment inside and outside portions 34 and 36. The attachment inside portion 34 includes an inside gripping portion 38 and an inside channel forming portion 40. The attachment outside portion 36 includes an outside gripping portion 42 and an outside channel forming portion 44. As seen in FIG. 4, when the attachment 22 is operatively secured to the garment slide fastener 14, the inside and outside gripping portions 38 and 42 grip a gripped portion 46 of one of the stringer tapes 16 therebetween, and the inside and outside channel forming portions 40 and 44 define a channel 49 receiving thereinto the teeth 18 that are supported by the stringer tape 16 adjacent the gripped portion 46. The attachment 22 thus secures the garment extender 10 to the garment slide fastener 14.

Figure 8:
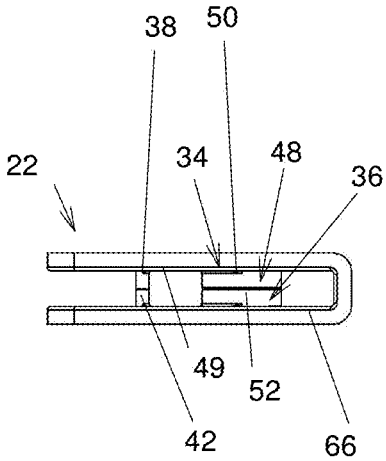
FIG. 8, in a top elevation view, illustrates the attachment of FIG. 5, the attachment being shown in a closed configuration.

Typically, the attachments 22 are removably attachable to the garment slide fastener 14. However, attachments 22 that permanently attach to the garment slide fastener 14 are within the scope of the present invention. In some embodiments, the attachment inside and outside portions 34 and 36 are movable relative to each other between a closed configuration, seen for example in FIG. 8, and an open configuration, seen for example in FIG. 5. The attachment 22 is in the closed configuration when the attachment 22 is attached to the garment slide fastener 14. The inside and outside gripping portions 38 and 42 are spaced apart from each other to a greater extent in the open configuration than in the closed configuration to allow detachment of the attachment 22 from the garment slide fastener 14.

In some embodiments (not shown in the drawings), the attachment inside and outside portions 34 and 36 are biased towards each other towards the closed configuration, for example by being mounted to a spring or other biasing element. In other embodiments, as in the attachment 22 shown in the drawings, each attachment 22 further includes a lock 48 for selectively locking the attachment 22 in the closed configuration. For example, the lock 48 prevents the attachment inside and outside portions 34 and 36 from moving from the closed configuration to the open configuration unless a predetermined force moving the attachment inside and outside portions 34 and 36 away from each other is exerted. In some embodiments, the predetermined force is such that the lock 48 unlocks if forces that could cause damage to the garment slide fastener 14 were exerted on the garment extender 10.

A specific example of the lock 48 includes lock inside and outside elements 50 and 52 provided respectively in the attachment inside and outside portions 34 and 36. The lock inside and outside elements 50 and 52 are complementarily shaped to snap to each other in the closed position. However, in alternative embodiments, any other suitable lock is used. For example, a lock using magnets is within the scope of the invention, magnets of opposing polarity facing each other in the attachment inside and outside portions 34 and 36 in the closed position. In yet other embodiments, the lock includes a biasing element, such as a spring, extending between the attachment inside and outside portions 34 and 36 and biasing the attachment inside and outside portions 34 and 36 towards the closed position.

For the purpose of this document, the term "snap" refers to a structure and an action in which one part defines a recess accessed through an opening narrower than deeper parts of the recess. Another part includes a pin that has a portion that is slightly larger than the opening. At least one of, and in some cases both, the pin and the opening is resiliently deformable so that when a suitable force is exerted pushing the pin into the recess, deformation occurs so that the portion that is slightly larger than the opening is allowed to move past the opening. Then, the pin and opening, reverse at least partially this deformation, with the portion that is slightly larger than the opening received in the recess, which locks the pin in the recess.

In a specific embodiment of the invention, the inside channel forming portion 40 is between the inside gripping portion 38 and lock inside element 50 and the outside channel forming portion 44 is between the outside gripping portion 42 and lock outside elements 52.

In a very specific embodiment of the invention, the attachment inside and outside portions 34 and 36 are formed of a relatively rigid polymer and structured as follows. In this specific embodiment, the attachment inside and outside portions are identical, and only one of them, the attachment inside portion 34, is described in details.

Figure 6:
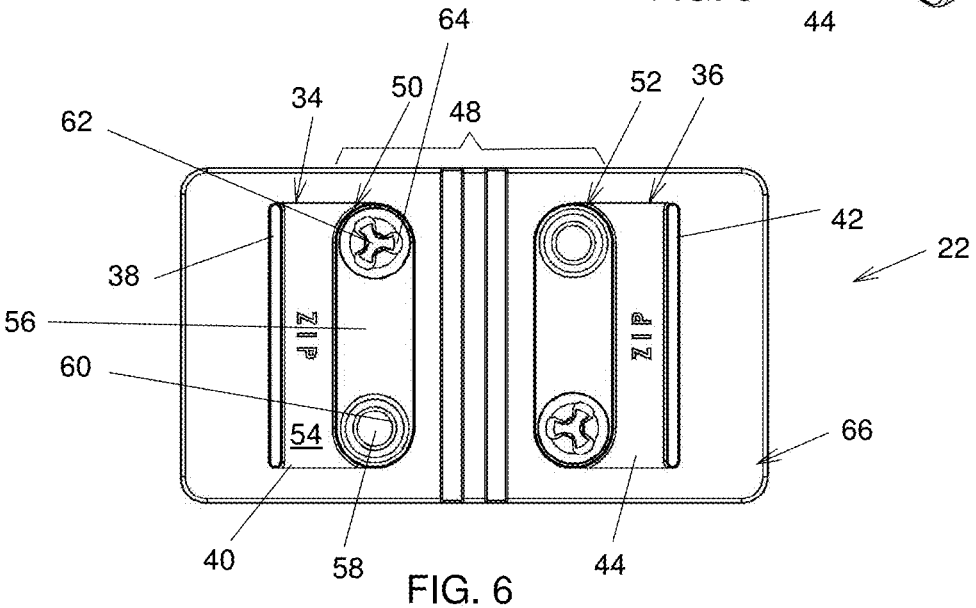
FIG. 6, in a front plan view, illustrates the attachment of FIG. 5.

Referring to FIG. 6, the attachment inside portion 34 includes a base 54, which is for example plate-shaped. The inside gripping portion 38 is a flange extending from the base 54. The flanges of the attachment inside and outside portions 34 and 36 face each other and grip the stringer tape 16 therebetween in the closed configuration. For example, this flange has a length sufficient to extend along a few teeth 18 of the garment slide fastener 14 to distribute stresses exerted on the garment slide fastener 14 over a relatively large portion of the garment slide fastener 14 when the garment extender 10 is in use to reduce possibilities of damaging the garment slide fastener 14.

The lock inside element 50 includes a locking element base 56 extending substantially parallel to the inside gripping portion 38, spaced apart therefrom. The inside channel forming portion 40 is delimited by the locking element base 56 and inside gripping portion 38. In some embodiments, the locking element base 56 and inside gripping portion 38 protrude at about the same height from the base 54.

The lock inside element 50 also includes a recess 58 extending in the base 54, accessed through an opening 60 that is at least slightly narrower than the remainder of the recess 58. Furthermore, the lock inside element 50 includes a prong 62 protruding from the base 54. The prong 62 includes a prong wider portion 64 that is slightly larger than the opening 60. The prong 62 and recess 58 are positioned such that when two of the lock inside elements 50 are positioned so that their inside gripping portions 38 face each other, the prong 62 of one of the lock inside elements 50 faces the recess 58 of the other one of the lock inside elements 50, so that the prongs 62 can engage the recesses 58. The recesses 58 and prongs 62 are configured and sized, and have mechanical properties, such that the above-described snap action occurs when the prongs 62 are pushed into the recesses 58.

In some embodiments, the attachment inside and outside portions 34 and 36 could be each attached, for example using glue, to the body 21. However, in some embodiments, the attachment 22 includes an attachment linking portion 66 (seen in FIG. 6 for example) linking the attachment inside and outside portions 34 and 36 to each other. Such a structure facilitates alignment between the attachment inside and outside portions 34 and 36 to achieve the closed configuration. For example, the attachment inside and outside portions 34 and 36 are more rigid than the attachment linking portion 66. The latter is for example relatively flexible to relatively easily allow movements between the open and closed configurations.

Figure 7:
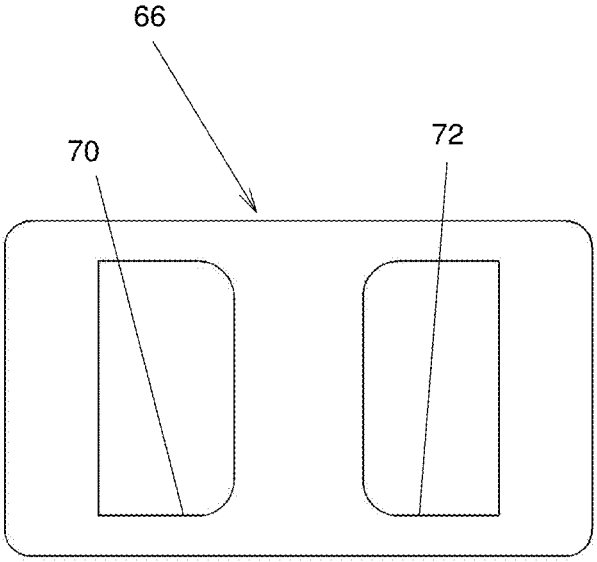
FIG. 7, in a front plan view, illustrates a linking portion part of the attachment of FIG. 5.

Referring to FIG. 7, for example, the attachment linking portion 66 is substantially panel shaped and defines inside and outside portion apertures 70 and 72 respectively receiving the attachment inside and outside portions 34 and 36 (not seen in FIG. 7) thereinto. The attachment linking portion 66 may be made of a polymer overmolded on the attachment inside and outside portions 34 and 36. In some embodiments, as seen in FIG. 6 for example, the attachment linking portion 66 defines at least one groove 74 thereinto, for example two grooves 74, between the inside and outside portion apertures 70 and 72 for facilitating hinging between the attachment inside and outside portions 34 and 36.

In some embodiments, the attachment linking portion 66 is soft enough to allow sewing the attachment linking portion 66 to pieces of fabric. This is advantageous as sewing is a robust and relatively low cost method of attaching components that is well understood in the garment industry.

Referring to FIG. 4, when the attachments 22 are provided in attachment strings 32, the attachment strings 32 may be formed as follows. Each string of attachments includes inside and outside strips 76 and 78, made of a suitable fabric. The inside and outside strips 76 and 78 extend between the attachments 22 and the body 21. The inside and outside strips 76 and 78 may be formed of a single piece of material folded along a fold 80 separating the inside and outside strips 76 and 78 from each other. In alternative embodiments, the inside and outside strips 76 and 78 are made of two different pieces of material. The attachment linking portion 66 of each attachment 22 is secured to the inside and outside strips 76 and 78 and the inside and outside strips 76 and 78 are secured to the body 21. For example, the inside and outside strips 76 and 78 extend generally parallel to each other.

The inside strip 76 has an inside strip side edge 82, opposed to the fold 80 and the outside strip 78 has an outside strip side edges 86, opposed to the fold 80. Adjacent the fold 80, the inside and outside strips 76 and 78 overlap one of the body first and second side edges 24 and 26, the body first side edge 24 being shown in FIG. 4. Part of the body 21 is secured to the inside and outside strips 76 and 78. This layered structure including the inside and outside strips 76 and 78 with part of the body 21 therebetween can be sewn or assembled in any other suitable manner.

The attachments 22 are provided between the inside and outside strips 76 and 78. In some embodiments, the inside and outside strips 76 and 78 are folded over the attachment linking portion 66 adjacent the inside and outside strips side edges 82 and 86 and the layered structure formed of part of one of the inside and outside strips 76 and 78, the attachment linking portion 68 and another part of the same one of the inside and outside strips 76 and 78 is sewn together, or otherwise secured, for example using glue or rivets, among other possibilities.

Figure 13:
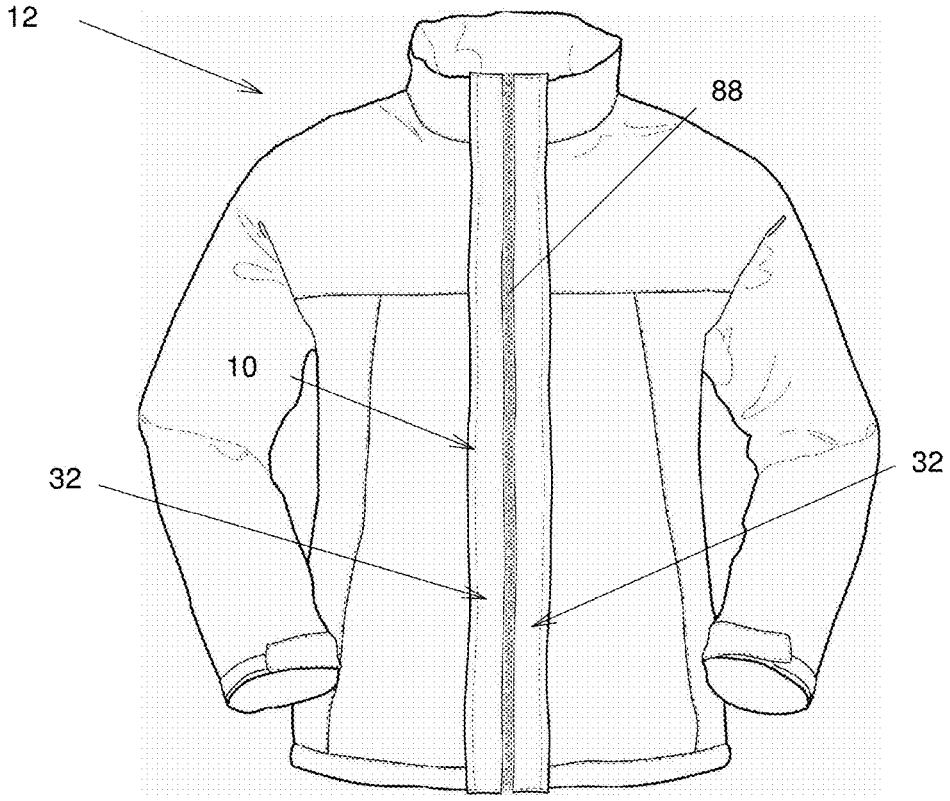
FIG. 13, in a front elevation view, illustrates the garment and garment extender of FIG. 2 with part of the garment extender between two garment slide fasteners removed.

As seen in FIG. 2, in some embodiments, the body 21 is provided with at least one extender slide fastener 88 extending between the body top and bottom edges 28 and 30, which allows opening the garment 12 without removing the garment extender 10. In some embodiments, the garment extender 10 is provided with a pair of laterally spaced apart extender slide fasteners 88 extending between the body top and bottom edges 28 and 30. This allows removal of part of the garment extender 10, the part between the two extender slide fasteners 88, as seen in FIG. 13, while preserving the ability to close and open the garment 12. Also, many different pieces of materials securable to the extender slide fasteners 88 having different widths could be provided to adjust the garment extender 10 to different sizes. In some embodiments, the removable portion includes a wider portion and a narrower portion. When the wider portion is worn over the belly of a pregnant woman, the garment extender 10 may be used to accommodate the expanding belly of the pregnant woman. When the wider portion is worn over the chest of an intended user, which may be achieved by mounting the garment extender 10 upside down with respect to the orientation in which the wider portion is over the belly, a baby carrier carrying a baby may be worn in register with the chest of the intended user and the garment extender 10 may then accommodate the additional volume occupied by the baby and baby carrier.

Figure 9:
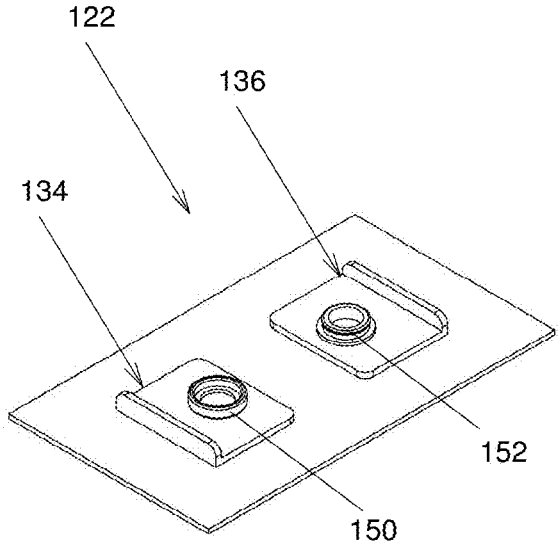
FIG. 9, in a perspective view, illustrates an alternative attachment usable in the garment extender of FIG. 2.
Figure 10:
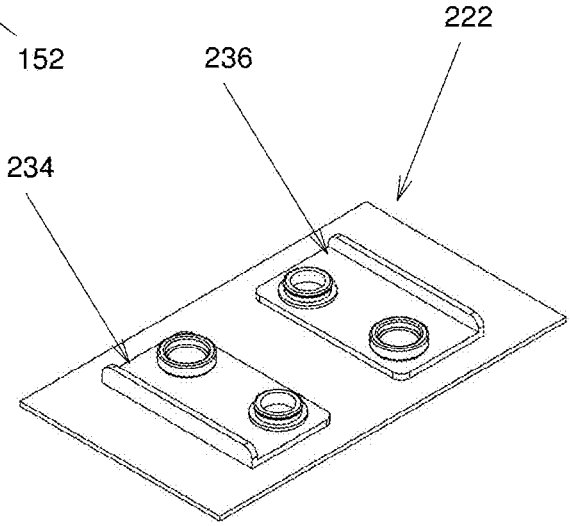
FIG. 10, in a perspective view, illustrates an other alternative attachment usable in the garment extender of FIG. 2.

FIG. 9 illustrates another attachment 122 usable instead of the attachment 22 in the garment extender 10. The attachment 122 differs from the attachment 22 in that the attachment inside and outside portions 134 and 136 have lock inside and outside elements 150 and 152 that differ from the lock inside and outside elements 50 and 52. More specifically, while still employing the "snap" principle, the lock inside and outside elements 150 and 152 don't include the locking element base 56. Instead, the lock inside and outside elements 150 and 152 have a structure similar to that of a conventional push button used commonly in the garment industry. Also, the attachment inside and outside portions 134 and 136 are not identical as they each include a single element part of the conventional push button structure, which need to be complementarily shaped to the other element of the conventional push button structure. In alternative embodiments, the same push button structures are used, but two of them are present on each of the attachment inside and outside portions 234 and 236, as seen in FIG. 10 for the attachment 222.

Figure 11:
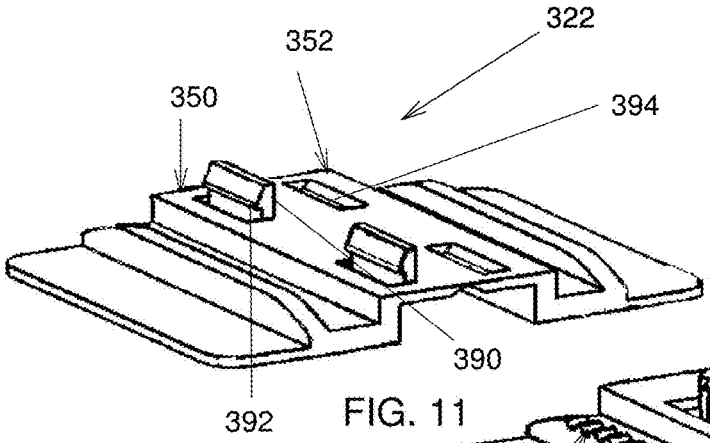
FIG. 11, in a perspective view, illustrates yet an other alternative attachment usable in the garment extender of FIG. 2.

FIG. 11 illustrates yet another attachment 322 usable instead of the attachment 22 in the garment extender 10. The attachment 322 differs from the attachment 22 in that the lock inside and outside elements 350 and 352 differ from the lock inside and outside elements 50 and 52. One of the lock inside and outside elements 350 and 352 include at least one deformable elongated tongue 390 provided with a ledge 392 generally transversal to the tongue 390. The tongue 390 is insertable in a recess 394 of the other one of the lock inside and outside elements 350 and 352 by resiliently deforming the tongue 390 until the tongue 390 has been inserted enough that it can spring back to its undeformed configuration with the ledge 392 abutting against a correspondingly shaped portion of the recess 394 so that removal of the tongue 390 from the recess 394 requires deformation of the tongue 390 to retract the ledge 392 so that the later can be retracted from the recess 394. In other embodiments, the tongue 390 deforms enough to be removed from the recess 394 when enough pulling force is exerted thereonto. The attachment 322 includes a pair of tongues 390 and recess 394.

Figure 12:
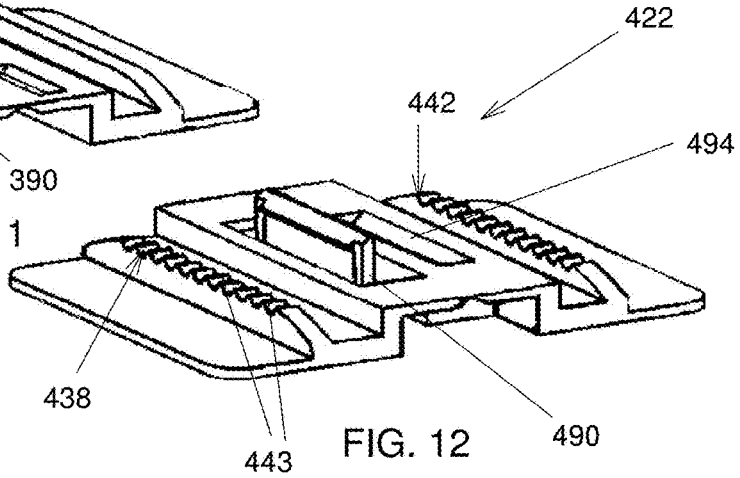
FIG. 12, in a perspective view, illustrates yet an other alternative attachment usable in the garment extender of FIG. 2.

FIG. 12 illustrates yet another attachment 422 usable instead of the attachment 22 in the garment extender 10. The attachment 422 is similar to the attachment 322 except that it includes only one tongue 490 and one recess 494, which are longer than the tongue 390 and recess 394. Also, the attachment 422 includes inside and outside gripping portions 438 and 442 that are provided with teeth 443 to better grip the stringer tapes 16.

Figure 16:
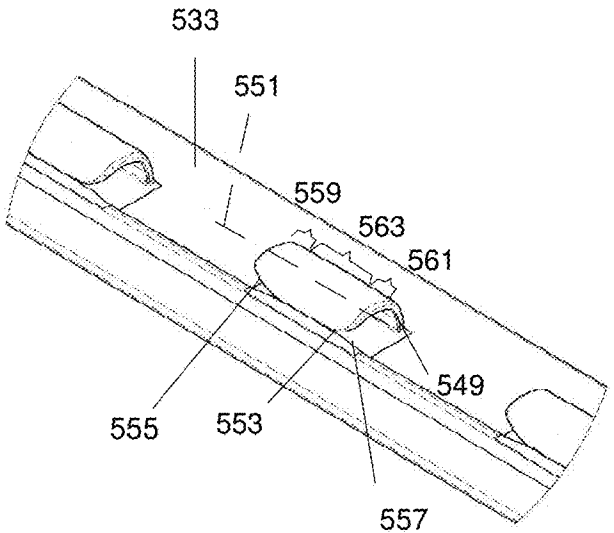
FIG. 16, in a partial perspective view, illustrates a portion of the attachment string of FIG. 15
Figure 15:
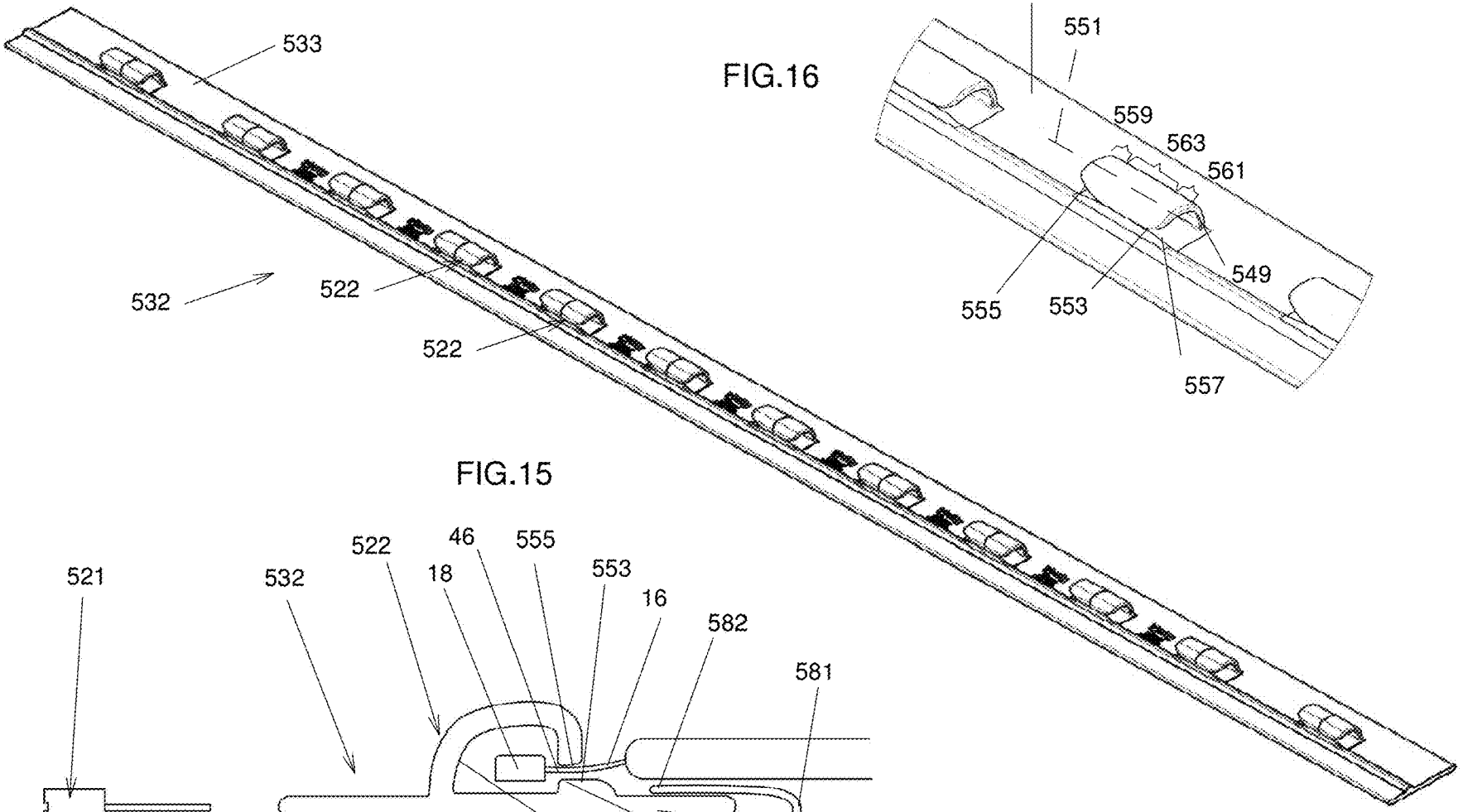
FIG. 15, in a perspective view, illustrates an attachment string including a flexible link to which are secured a series of the attachments of FIG. 14.
Figure 17:
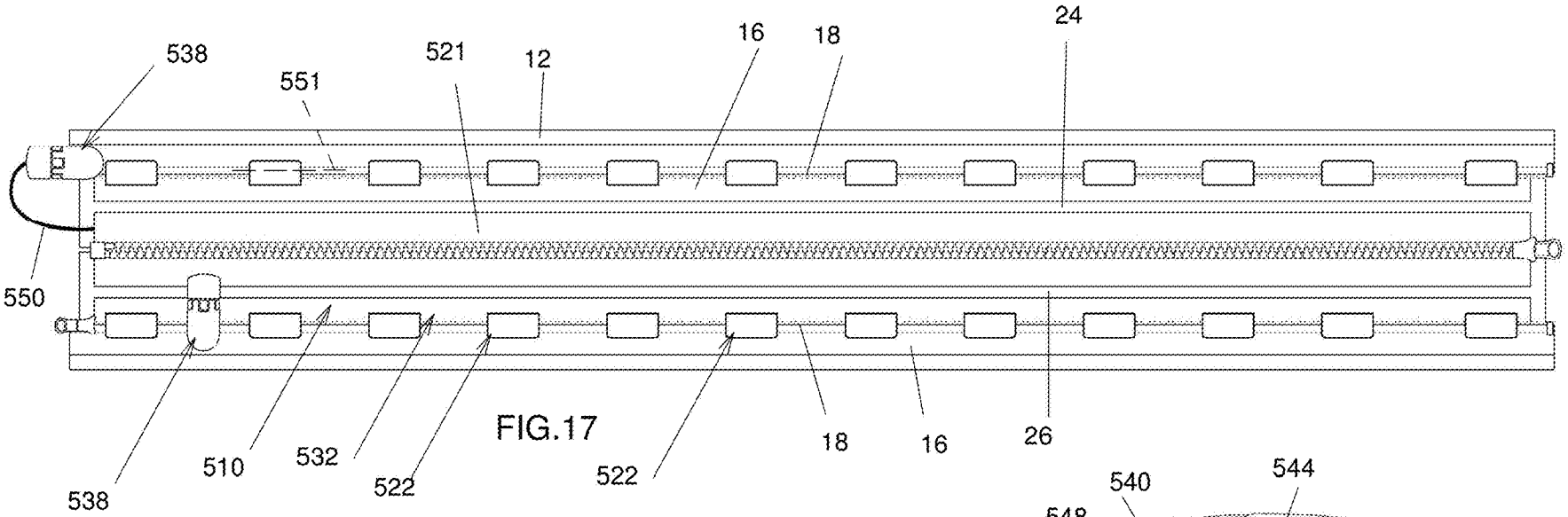
FIG. 17, in a rear elevation view, illustrates part of the garment of FIG. 2 and a garment extender similar to the garment extender of FIG. 2, in which the attachments are the attachments of FIG. 14 linked to each other in the attachment string of FIGS. 15 and 16, with a part of the garment extender between two garment slide fasteners removed.

FIGS. 14 to 20 present various aspects related to yet another attachment 522 usable instead of the attachment 22 in an alternative garment extender 510, the latter being shown in FIG. 17. Typically, but not necessarily, a plurality of attachments 522 are used to secure the body 521 to the garment 12, as in the garment extender 10. The attachments 522 could be individually secured to the body 21, for example using stitches, rivets or an adhesive. However, in some embodiments, the attachments 522 are linked to each other in an attachment string 532 through a flexible link 533, as shown in FIG. 15 for example and further described hereinbelow.

Figure 14:
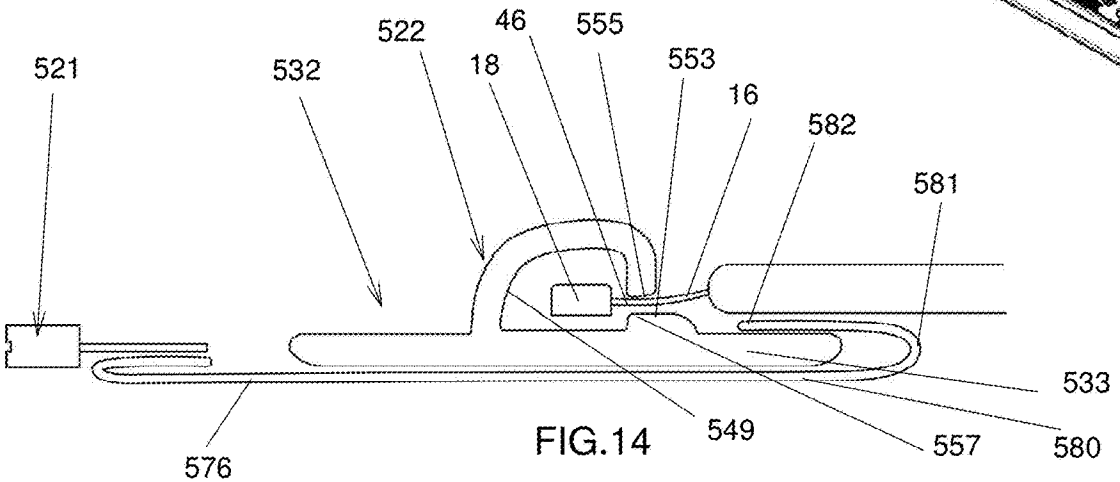
FIG. 14, in a top plan view, illustrates yet another attachment usable in the garment extender of FIG. 2.

Referring to FIG. 16, each of the attachments 522 defines a channel 549 defining a channel axis 551 extending substantially parallel to one of the body first and second side edges 22 or 24 at which the attachment 522 is provided, as seen in FIG. 17. Returning to FIG. 16, each of the attachments 522 also define a slit 553 parallel to the channel axis 551 and leading laterally into the channel 549 along the whole channel 549. As seen in FIG. 14, the slit 553 of each attachment 522 faces away from the body 521.

As seen in FIG. 16, each slit 553 is defined between a pair of slit edges 555 and 557. Each slit 553 defines axially opposed slit end portions 559 and 561 and a slit intermediate portion 563 therebetween. At least one of the slit edges 555 and 557, for example both slit edges 555 and 557 as seen in FIG. 16, is bevelled in the slit end portions 559 and 561 so that an axial access to the slit 553 is tapered towards the slit intermediate portion 563. This configuration facilitates sliding the attachments 522 along the stringer tapes 16.

In some embodiments, the attachments 522 may be slightly flexible so that the slit 553 may be widened slightly against a biasing force forcing the slit edges 555 and 557 away from each other when the stringer tape 16 is inserted thereinto, so that the attachments 522 engage the stringer tape 16 with a small axial friction force. In other embodiments, the slits 553 are be wider than the typical thickness of the stringer tape 16.

As seen in FIG. 14, the attachments 522 may have a substantially C-shaped transversal cross-sectional configuration. With the attachments 522 operatively secured to the garment slide fastener 14, the slit 553 of each attachment 522 receives thereinto a gripped portion 46 of one of the stringer tapes 16 therebetween and the channel 549 of the attachment 522 receives thereinto the teeth 18 that are supported by the stringer tape 16 adjacent the gripped portion 46.

It should be noted that in opposition to the attachments 22, the attachments 522 typically don't grip the stringer tapes 18 with a large force, but are movable therealong by exerting a relatively small force. Thus, the gripping force is such that friction between the attachments 522 and the stringer tapes 16 is relatively low. As described hereinbelow, in some embodiments, a clip 538 (seen in FIG. 17 for example) is used to prevent the attachments 522 from sliding out of the stringer tape 16. However, in alternative embodiments, the attachments 522 grip the stringer tape 16 with enough force that the clip 538 is not required. Also, the channel 549 has a transversal cross-sectional configuration such that the teeth 18 of commercially available slide fasteners 14 may be freely received thereinto with minimal or no friction.

To ensure that the teeth 18 cannot exit the attachment 522 through the slit 553, the latter has a relatively narrow width, and, when the attachments 522 are deformable, the attachment 522 is rigid enough to prevent excessive deformation that would allow such movement of the teeth 18 through the slit 553.

With reference to FIG. 15, the attachments 522 provided at at least one of the body first and second side edges 24 and 26, and typically at both of the body first and second side edges 24 and 26, are linked to each other in an attachment string 532 through a flexible link 533. Typically, the flexible link 533 is less rigid than the attachments 522. The attachments 522 are secured to the flexible link 533 in any suitable manner. For example, the attachments 522 are glued to the flexible link 533. In other embodiments, the attachments 522 define a peripherally extending flange (not shown in the drawings) that is embedded in the flexible link 533, for example by overmolding that latter over the attachments 522, and more specifically the flanges. Any other suitable manner of securing the attachments 522 to the flexible link 533 is also within the scope of the invention.

As seen in FIG. 14, the attachment string 532 may be secured to a strip 576 part of the body 521 and extending parallel to the flexible link 533, similarly to the use of the strips 76 and 78 in the garment extender 10. The strip 576 may be folded over itself at one strip side edge 582 thereof to form a fold 581 folding over the flexible link 533. The folded strip 576 may be secured in any suitable manner to the flexible link 533, for example using stitches, rivets or an adhesive, among other possibilities.

Figure 18:
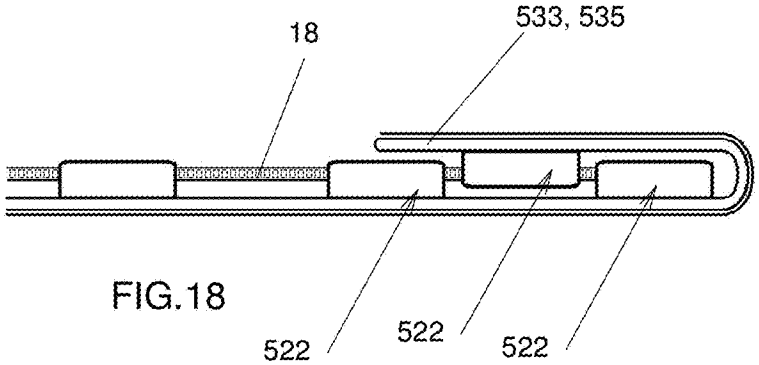
FIG. 18, in a side elevation view, illustrates the attachment strip of FIGS. 15 and 16 with the flexible link folded over itself at a link end thereof.

The attachments 522 include two opposed end attachments 522 and intermediate attachments 522 provided therebetween. In some embodiments, as seen in FIG. 18, with the flexible link 533 folded over itself adjacent one link end 535 thereof, the end attachment 522 adjacent to that link end 535 is insertable between two adjacent ones of the intermediate attachments 522. This is possible if the spacing between the end attachment 522 and the intermediate attachment 522 to which it is adjacent is large enough to allow such a fold and if the distance between the two intermediate attachments is larger than the length of the end attachment 522. This ability to fold over the attachment string 532 and insert the end attachment 522 between two intermediate attachments 522 is useful to shorten the attachment string 532 so that the attachment string 532 can be used with garment slide fasteners 14 of different lengths. Indeed, the folded over portion can be maintained folded by simply engaging the stringer tape 16 between the two intermediate attachments 522 with the end attachment 522.

In some embodiments, a clip 538 is provided, as seen in FIG. 17. The clip 538 is operable for gripping the stringer tape 16. When the clip 538 grips the stringer tape, the attachment string 532, and therefore the attachments 522 may be maintained at a fixed location relative thereto. This functionality may be achieved in many alternative manners. Two such manners are illustrated in FIG. 17. It should be noted that in some embodiments, only one of these manners is implemented, at one or both sides of the garment extender 510.

Figure 20:
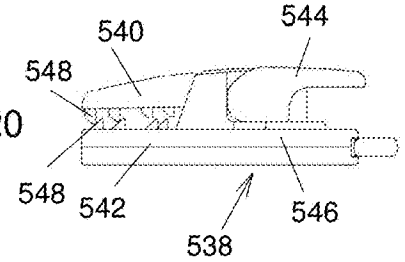
FIG. 20, in a side elevation view, illustrates the clip of FIG. 19, the clip being shown in a closed configuration.
Figure 19:
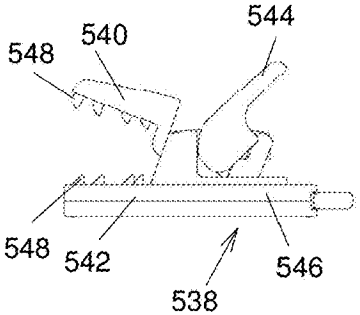
FIG. 19, in a side elevation view, illustrates a clip usable in conjunction with the attachments of FIG. 14, the clip being shown in an open configuration.

FIGS. 19 and 20 illustrate the clip 538. The clip 538 is movable between open and closed configurations, shown respectively in FIGS. 19 and 20. The clip 538 includes a pair of jaws 540 and 542 that are adjacent to each other in the closed configuration, and spaced apart from each other in the open configuration. The jaws 540 are operated using levers 544 and 546 extending respectively from the jaws 540 and 542. The lever 546 extends integrally from the jaw 542 in the embodiment of the clip 538 shown in FIGS. 19 and 20, but other types of levers are within the scope of the invention. The jaws 540 and 542 may be biased towards the closed configuration, for example using a biasing element, or the clip 538 may be configured so that when the jaws 540 and 542 are in the closed configuration, a minimal force is required to achieve the open configuration, so that the jaws are maintained in the closed configuration unless this minimal force is exerted. The jaws 540 and 542 may also be provided with protrusions 548 configured to engage or penetrate any piece of fabric or any soft material provided between the two jaws 540 and 542. Examples of suitable clips 538 are provided in U.S. Pat. No. 8,806,726 issued Aug. 19, 2014 to Tien Chung Ent Co Ltd and in U.S. Pat. No. 7,979,965 issued Jul. 19, 2011 to Tien Chung Ent Co Ltd, the contents of which are hereby incorporated by reference in their entirety. However, any other suitable clip may be used.

Referring to FIG. 17, the clip 538 may be secured to the remainder of the garment extender 510 in many different manners. For example, as shown for the bottom clip 538 in FIG. 17, the clip 538 is secured to one of the body 521 and flexible link 533 between two adjacent ones of the attachments 522. In FIG. 17, the clip 538 is secured to the body 521 with the jaws 540 and 542 positioned between two attachments 522. With the garment extender 510 operatively secured to the garment 12 (only partially shown in FIG. 17), the clip 538 is operable for selectively and reversibly gripping one of the stringer tapes 16 between the two adjacent ones of the attachments 522. When this is achieved, the attachments 522 are prevented from sliding along the stringer tapes 16 accidentally.

Another manner of providing the clip 538 is illustrated for the top clip 538 of FIG. 17. The clip 538 is secured to the body 521, for example using a small piece of rope 550, one end of which being secured to the body 521, and the other end of which being secured to the clip 538. Thus, this clip 538 may be moved relative to the remainder of the garment extender 510. The rope 550 is positioned and configured so that with the garment extender 510 operatively secured to the garment 12, the clip 538 is operable for selectively and reversibly gripping jointly one of the flexible links 533 and one of the stringer tapes 16 adjacent to the one of the flexible link 533. Indeed, in this configuration, when the attachments 522 receive therebetween the stringer tape 16, the stringer tape 16 and flexible link 533 run parallel and adjacent to each other. The clip 538 can therefore receive between its jaws 540 and 542 the stringer tape 16 and flexible element 533, for example at the top or bottom ends thereof.

While each side of the garment extender 510 is provided with only one clip 538 in FIG. 17, it is within the scope of the invention to provide more than one clip 538 for each side of the garment extender 510, for example one adjacent the top of the garment extender 510, and one adjacent the bottom of the garment extender 510, among other possibilities.

In use, the garment extender 510 is secured to the garment 12 by simply aligning the teeth 18 of one half of the slide fastener at one end thereof with one of the channels 549 of one of the end attachments 522 and pulling this end attachment 522 along the stringer tape 16. As they reach the stringer tape 16, the other attachments 522 may be automatically aligned with the stringer tape 16 if the flexible link 533 has enough rigidity, or may need a bit of adjustment by the intended user to be suitably aligned to suitably engage the stringer tape 16 with the teeth 18 positioned in the channel 549. If needed, the flexible link 533 is folded over itself when the end of the attachment string 532 is reached so that the end attachment 522 can be suitably positioned to achieve the configuration of FIG. 18. Then, the clip 538 is used to ensure that the attachments 522 remain fixed relative to the garment 12. The other half of the garment extender 510 can be simultaneously secured to the garment 12 with the first half. In other embodiments, when the garment extender 510 includes two portions that can be detached from each other, each portion can be secured individually to the garment 10, followed by attachment to each other of the two separated portions.

Figure 21:
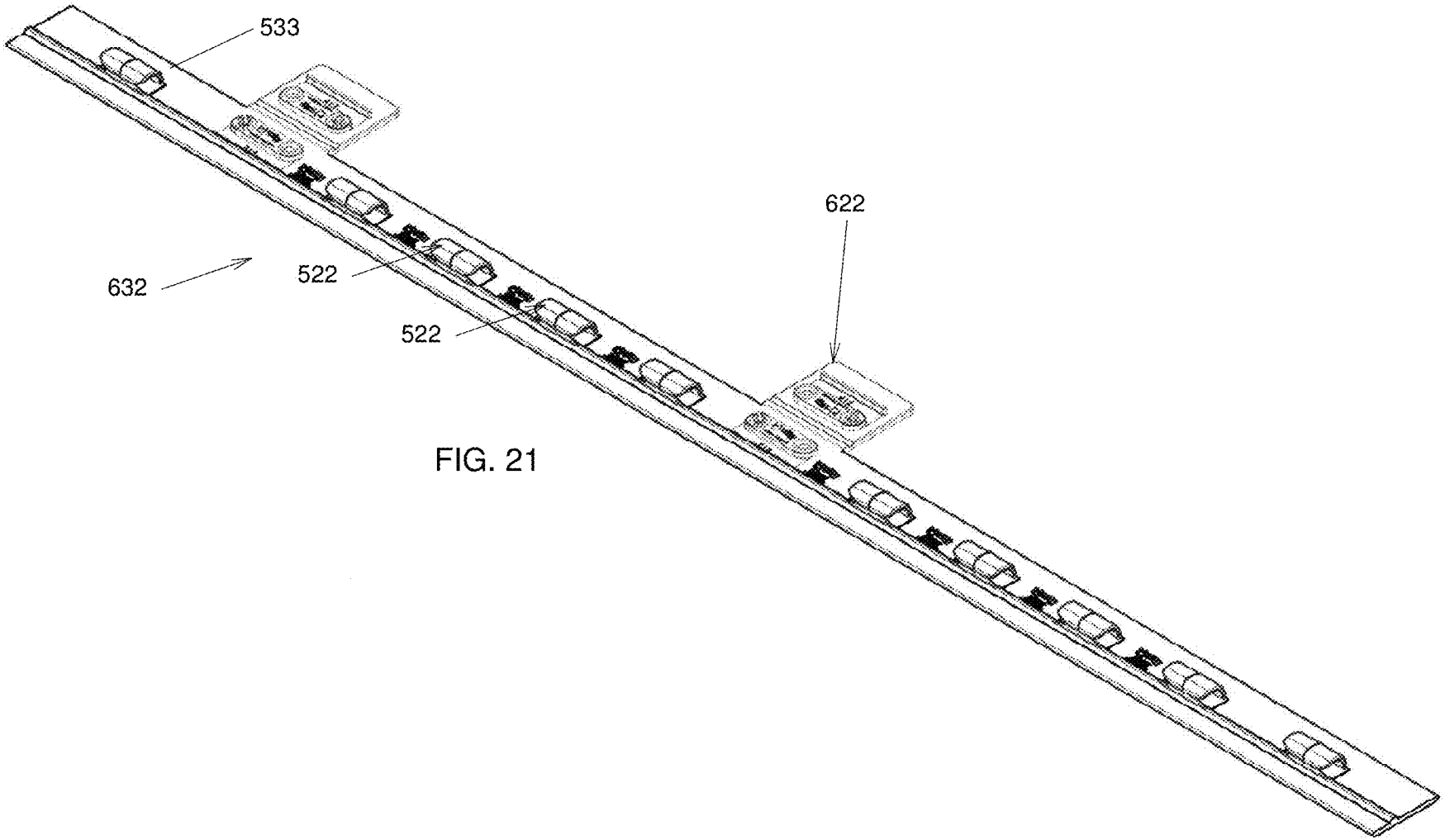
FIG. 21, in a perspective view, illustrates an attachment string in accordance with another embodiment of the present invention.

FIG. 21 illustrates another attachment string 632 usable in the garment extender 510 instead of the attachment string 532. The attachment string 632 is very similar to the attachment string 532 except that it also includes a fixation attachment 622, which is similar in shape and function to the attachments 22, 122, 222, 322 and 422. The fixation attachment 622 is secured to the flexible link 533 along the line defined by the attachments 522 in any suitable manner, for example through overmolding or use of an adhesive, among other possibilities. The attachment string 632 includes two fixation attachments 622, but attachment strings 632 including only one fixation attachments 622 or more than two fixation attachments 622 are also possible. In use, the attachment string 632 is used similarly to the attachment string 532, except that when the attachment string 632 is properly positioned, the fixation attachment 622 is closed to securely grip the stringer tape 16. In such embodiments, the clips 538 may not be required and may be omitted.

Although the present invention has been described hereinabove by way of exemplary embodiments thereof, it will be readily appreciated that many modifications are possible in the exemplary embodiments without materially departing from the novel teachings and advantages of this invention. Accordingly, the scope of the claims should not be limited by the exemplary embodiments, but should be given the broadest interpretation consistent with the description as a whole.

What is claimed is:

1. A garment extender usable with a garment having a garment slide fastener, the garment slide fastener having a pair of substantially elongated stringer tapes supporting each a row of teeth extending longitudinally therealong, the garment slide fastener also having a slider movable along the rows of teeth in a reciprocating movement for selectively attaching the teeth of both rows to each other when moved in a closing direction and selectively detaching the teeth of both rows from each other when moved in an opening direction opposed to the closing direction, the garment extender comprising:

a body defining substantially opposed body first and second side edges and opposed body top and bottom edges extending each between the body first and second side edges;

a plurality of attachments each provided at one of the body first and second side edges, each of the attachments defining a channel defining a channel axis extending substantially parallel to one of the body first and second side edges at which the attachment is provided, each of the attachments also defining a slit leading laterally into the channel along the whole channel, the slit being configured and sized to allow the attachments to slide along the stringer tapes;

wherein, with the attachments operatively secured to the garment slide fastener, the slit of each attachment receives thereinto a received portion of one of the stringer tapes therebetween and the channel of the attachment receives thereinto the teeth that are supported by the stringer tape adjacent the received portion, the attachments being slidable along the stringer tapes so that the garment extender is mountable the garment and removable therefrom by sliding the attachments along the stinger tapes.

2. The garment extender as defined in claim 1, wherein the attachments are spaced apart from each other along the first and second side edges.

3. The garment extender as defined in claim 2, wherein the attachments provided at one of the body first and second side edges are linked to each other in an attachment string through a flexible link.

4. The garment extender as defined in claim 3, wherein the flexible link is less rigid than the attachments.

5. The garment extender as defined in claim 3, further comprising a clip operable for gripping the stringer tape to maintain the stringer tape and the garment extender substantially fixed relative to each other.

6. The garment extender as defined in claim 5, wherein, with the garment extender operatively secured to the garment, the clip is operable for selectively and reversibly gripping jointly one of the flexible link and one of the stringer tapes adjacent to the one of the flexible link.

7. The garment extender as defined in claim 6, wherein the clip is secured to one of the body and flexible link between two adjacent ones of the attachments and, with the garment extender operatively secured to the garment, the clip is operable for selectively and reversibly gripping one of the stringer tapes between the two adjacent ones of the attachments.

8. The garment extender as defined in claim 3, wherein the attachments provided at at least one of the body first and second side edges include two opposed end attachments and intermediate attachments provided therebetween, wherein, with the flexible link folded over itself adjacent one link end thereof, the end attachment adjacent to the one link end is insertable between two adjacent ones of the intermediate attachments.

9. The garment extender as defined in claim 1, wherein each slit is defined between a pair of slit edges, each slit defining axially opposed slit end portions and a slit intermediate portion therebetween, at least one of the slit edges being bevelled in the slit end portions so that an axial access to the slit is tapered towards the slit intermediate portion.

10. The garment extender as defined in claim 1, wherein the attachments have a substantially C-shaped transversal cross-sectional configuration.

11. The garment extender as defined in claim 1, wherein the slits face away from the body.

12. The garment extender as defined in claim 1, wherein the garment extender is provided with an extender slide fastener extending between the body top and bottom edges.

13. The garment extender as defined in claim 1, wherein the garment extender is provided with a pair of laterally spaced apart extender slide fasteners extending between the body top and bottom edges.

14. The garment extender as defined in claim 1, wherein the slit is parallel to the channel axis.

15. The garment extender as defined in claim 1, further comprising a fixation attachment, the fixation attachment including attachment inside and outside portions, the attachment inside portion including an inside gripping portion and an inside channel forming portion, the attachment outside portion including an outside gripping portion and an outside channel forming portion; wherein with the fixation attachment operatively secured to the garment slide fastener, the inside and outside gripping portions form a fixation attachment slit gripping a fixation gripped portion of one of the stringer tapes therebetween and the inside and outside channel forming portions define a fixation attachment channel receiving thereinto the teeth that are supported by the stringer tape adjacent the fixation gripped portion, the attachment inside and outside portions being movable relative to each other between a closed configuration and an open configuration, the fixation attachment being in the closed configuration when the fixation attachment is attached to the garment slide fastener and the inside and outside gripping portions being spaced apart from each other to a greater extent in the open configuration than in the closed configuration to allow detachment of the fixation attachment from the garment slide fastener, the fixation attachment further including a lock for selectively locking the fixation attachment in the closed configuration.

16. The garment extender as defined in claim 1, wherein the attachment is made of a single unhinged unitary piece of material.

17. The garment extender as in claim 1, wherein the garment extender is attached to a jacket, the jacket having a garment slide fastener, the garment slide fastener having a pair of substantially elongated stringer tapes supporting each a row of teeth extending longitudinally therealong, the garment slide fastener also having a slider movable along the rows of teeth in a reciprocating movement for selectively attaching the teeth of both rows to each other when moved in a closing direction and selectively detaching the teeth of both rows from each other when moved in an opening direction opposed to the closing direction, the garment extender being attached to the jacket between the stringer tapes of the garment slide fastener.

18. The garment extender as defined in claim 17, wherein the slits are wider than a thickness of the stringer tapes.

19. The garment extender as defined in claim 17, wherein the slits are narrower than a thickness of the stringer tapes before mounting to the stringer tapes, the attachments being flexible so that the slits are widened when mounted to the stringer tapes.

20. A garment extender usable with a garment having a garment slide fastener, the garment slide fastener having a pair of substantially elongated stringer tapes supporting each a row of teeth extending longitudinally therealong, the garment extender comprising:

a body defining substantially opposed body first and second side edges and opposed body top and bottom edges extending each between the body first and second side edges;

a plurality of attachments each provided at one of the body first and second side edges, each of the attachments defining a channel defining a channel axis extending substantially parallel to one of the body first and second side edges at which the attachment is provided, each of the attachments also defining a slit parallel to the channel axis and leading laterally into the channel along the whole channel;

wherein, with the attachments operatively secured to the garment slide fastener, the slit of each attachment receives thereinto a received portion of one of the stringer tapes therebetween and the channel of the attachment receives thereinto the teeth that are supported by the stringer tape adjacent the received portion, the attachments being slidable along the stringer tapes so that the garment extender is mountable the garment and removable therefrom by sliding the attachments along the stinger tapes.

21. A method for mounting the garment extender as defined in claim 1 to a garment having a garment slide fastener, the garment slide fastener having a pair of substantially elongated stringer tapes supporting each a row of teeth extending longitudinally therealong, the method comprising:

(a) aligning the teeth of one half of the slide fastener with the channel of one of the attachments provided at a selected side from the body first and second side edges;

(b) moving the one of the attachments along the stringer tape to mount the attachment to the stringer tape; and (c) for successive attachments provided at the selected side, align the teeth of the one half of the slide fastener with the channel of the successive attachments provided at the selected side and move the successive attachments along the stringer tape to mount the successive attachments to the stringer tape while moving already mounted attachments along the stringer tape to provide space for the successive attachments to me mounted to the stringer tape.

22. The method as defined in claim 21, wherein after the one of the attachments has been mounted to the stringer tape, the successive attachments are automatically aligned with the stringer tape by moving already mounted attachments along the stringer tape.

23. The method as defined in claim 21, wherein after the one of the attachments has been mounted to the stringer tape, the successive attachments are aligned manually with the stringer tape before being engaged on the the stringer tape.

* * * * *